US008907239B2

(12) United States Patent
Gottschalk et al.

(10) Patent No.: US 8,907,239 B2
(45) Date of Patent: Dec. 9, 2014

(54) CIRCUIT INTERRUPTER AND INDICATOR APPARATUS

(75) Inventors: Andrew Lawrence Gottschalk, Pittsburgh, PA (US); Brian John Schaltenbrand, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 200 days.

(21) Appl. No.: 13/548,862

(22) Filed: Jul. 13, 2012

(65) Prior Publication Data

US 2014/0014483 A1 Jan. 16, 2014

(51) Int. Cl.
*H01H 9/00* (2006.01)

(52) U.S. Cl.
USPC ..... 200/308

(58) Field of Classification Search
USPC ..... 200/308
See application file for complete search history.

(56) References Cited

U.S. PATENT DOCUMENTS

| | | | | |
|---|---|---|---|---|
| 5,981,887 | A * | 11/1999 | Robarge et al. | 200/308 |
| 6,130,390 | A * | 10/2000 | Castonguay | 200/308 |
| 6,498,310 | B1 * | 12/2002 | Bugryn | 200/308 |
| 7,973,622 | B2 * | 7/2011 | Yang et al. | 335/13 |

FOREIGN PATENT DOCUMENTS

| | | | |
|---|---|---|---|
| DE | 199 55 588 | A1 | 5/2000 |
| EP | 0 612 087 | A1 | 8/1994 |
| EP | 1 895 556 | A1 | 3/2008 |
| EP | 2 242 078 | A1 | 10/2010 |

OTHER PUBLICATIONS

European Patent Office, "International Search Report and Written Opinion", Aug. 5, 2013, 10 pp.

* cited by examiner

*Primary Examiner* — Renee Luebke
*Assistant Examiner* — Lheiren Mae A Caroc
(74) *Attorney, Agent, or Firm* — Eckert Seamans Cherin & Mellott, LLC; Brij K. Agarwal

(57) ABSTRACT

A circuit interrupter includes an indicator apparatus having a pair of movable elements and a connection apparatus that enables the pair of movable elements to be cooperable. One of the movable elements is connected with an indicator element that indicates an OPEN and/or a CLOSED condition of the circuit interrupter. A pair of engagement structures are situated on the pair of movable elements and enable the pair of movable elements to be engageable with one another. A biasing element extends between the pair of movable elements and is configured to absorb some of the kinetic energy of a trip event, which resists breakage of the indicator apparatus. The indicator element changes states when the set of separable contacts are at a relatively small amount of separation and does not require the set of separable contacts to reach the end of their travel before changing state.

17 Claims, 7 Drawing Sheets

CIRCUIT INTERRUPTER AND INDICATOR APPARATUS

BACKGROUND OF THE INVENTION

1. Field

The disclosed and claimed concept relates generally to circuit interrupters and, more particularly, to an improved indicator apparatus to indicate an OPEN or CLOSED condition of a circuit interrupter.

2. Related Art

Circuit interrupters of various types are well known in the relevant art and are generally used to open a protected portion of a circuit during certain predefined conditions such as certain overcurrent conditions, under-voltage conditions, fault conditions, and the like. Circuit interrupters thus typically have a CLOSED condition wherein the protected portion of the circuit is closed and an OPEN condition in which the protected portion of the circuit is OPEN. The OPEN condition of the circuit interrupter can include both an OFF condition and a TRIPPED condition of the circuit interrupter, by way of example. A typical circuit interrupter may include a set of separable contacts which, when separated, open the protected portion of the circuit. Such circuit interrupters typically also include a mechanism of any of a variety of types that are well known in the relevant art that control movement of the set of separable contacts between the OPEN and CLOSED conditions of the circuit interrupter.

Certain types of circuit interrupters can include an indicator that may indicate either or both of the OPEN and CLOSED conditions of the circuit interrupter. Such an indicator may include one or more flags upon which words such as "OPEN", "CLOSED", and the like may be displayed at various times depending upon the condition of the circuit interrupter, and/or the flags may include, by way of example, green or red coloring to indicate the condition of the circuit interrupter. Such indicators typically have been connected in one fashion or another with the mechanism that controls the separation of the set of separable contacts. While known circuit interrupters have been generally effective for their intended purposes, they have not been without limitation.

Indicators of this type have occasionally become broken during a trip event due to an inability to withstand the kinetic energy that is applied to such indicators during the trip event, i.e., wherein the set of separable contacts of the circuit interrupter can be caused to separate extremely rapidly. Also, some indicators have experienced difficulty in accurately indicating the OPEN and CLOSED conditions when switching states of the circuit interrupter due to a mechanical delay that results from a relatively large movement in changing states of the set of separable contacts compared with a relatively small movement in changing states of an indicator. That is, a set of separable contacts may be electrically isolated from one another (thus causing the portion of the circuit that is protected by the circuit interrupter to be in an open condition) when the set of separable contacts are separated from one another by as little as one-quarter of an inch, but the mechanism that separates the set of separable contacts may continue to move the contacts apart until they are, say, an inch apart. If the indicator continues to indicate the CLOSED condition of the circuit interrupter between the time that such contacts are moving from the position separated by one-quarter of an inch and the position separated by one inch, the indicator would actually be indicating an erroneous condition of the circuit interrupter since the circuit interrupter is actually in an OPEN condition, albeit an intermediate one. Some circuit interrupters have employed an indicator which gradually changes from indicating a CLOSED condition to indicating an OPEN condition, such that it provides an indication that partially indicates "OPEN" and partially indicates "CLOSED", which is likewise erroneous since, strictly speaking, the circuit interrupter cannot be in both conditions at once. It thus would be desirable to provide an improved circuit interrupter and indicator that meet these and other limitations known in the relevant art.

SUMMARY OF THE INVENTION

An improved circuit interrupter includes an improved indicator apparatus having a pair of movable elements and a connection apparatus that enables the pair of movable elements to be cooperable. One of the movable elements is connected with an indicator element that is configured to indicate at least one of an OPEN condition and a CLOSED condition of the circuit interrupter. The connection apparatus includes a pair of engagement structures that are situated on the pair of movable elements and that enable the pair of movable elements to be engageable with one another. The connection apparatus further includes a biasing element that extends between the pair of movable elements and which is configured to absorb a certain portion of the kinetic energy generated during a trip event, which resists breakage of the indicator apparatus. The indicator apparatus is configured to enable the indicator element to change states when the set of separable contacts are at a relatively small amount of separation and without requiring the set of separable contacts to reach the end of their travel before changing state.

Accordingly, an aspect of the disclosed and claimed concept is to provide an improved indicator apparatus and resultant circuit interrupter that accurately indicate an OPEN condition and a CLOSED condition of the circuit interrupter.

Another aspect of the disclosed and claimed concept is to provide an improved indicator apparatus and an improved circuit interrupter that include a biasing element that extends between a pair of movable elements, wherein the biasing element can absorb at least some of the kinetic energy that is released in a trip event by a mechanism of the circuit interrupter that controls separation of the set of separable contacts.

Another aspect of the disclosed and claimed concept is to provide an improved indicator apparatus and resultant circuit interrupter that accurately indicate whether the circuit interrupter is in an OPEN condition or in a CLOSED condition.

Other aspects of the disclosed and claimed concept are provided by an improved indicator apparatus that is structured to be used in a circuit interrupter that includes a mechanism which is movable to switch the circuit interrupter between a CLOSED condition and an OPEN condition. The indicator apparatus can be generally stated as including a first movable element structured to be cooperable with the mechanism, an indicator element structured to be movable between a first position that corresponds with the CLOSED condition of the circuit interrupter and a second position that corresponds with the OPEN condition of the circuit interrupter, the indicator element in at least one of the first position and the second position being structured to output an indication representative of the condition of the circuit interrupter, a second movable element cooperable with the indicator element to move the indicator element between the first and second positions, and a connection apparatus situated on at least one of the first and second movable elements and structured to enable the first and second movable elements to be cooperable.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION OF THE PREFERRED EMBODIMENTS

Figure 1:
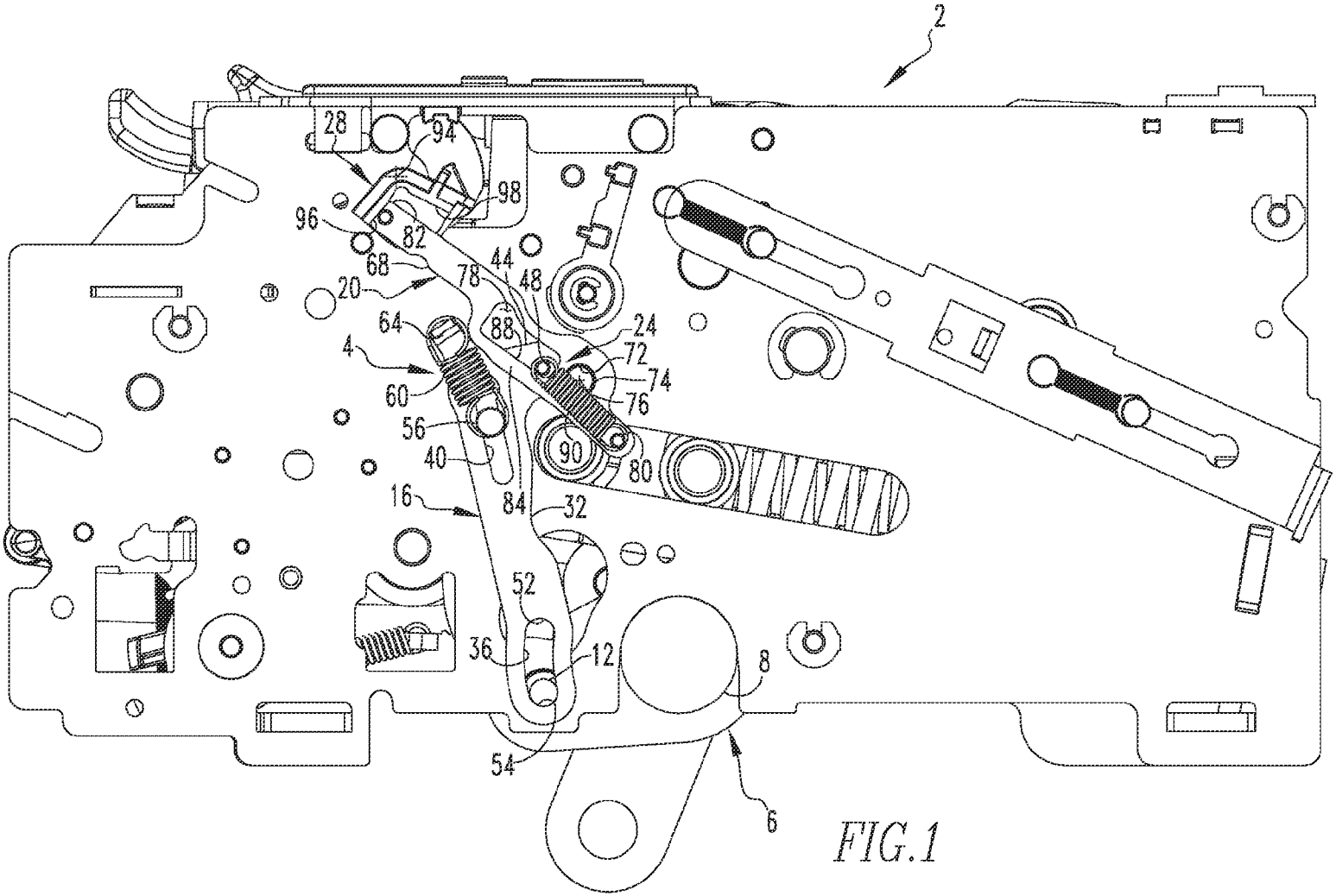
FIG. 1 is a side elevational view of an improved circuit interrupter in accordance with the disclosed and claimed concept that includes an improved indicator apparatus in accordance with the disclosed and claimed concept, with the circuit interrupter being in a CLOSED condition.
Figure 2:
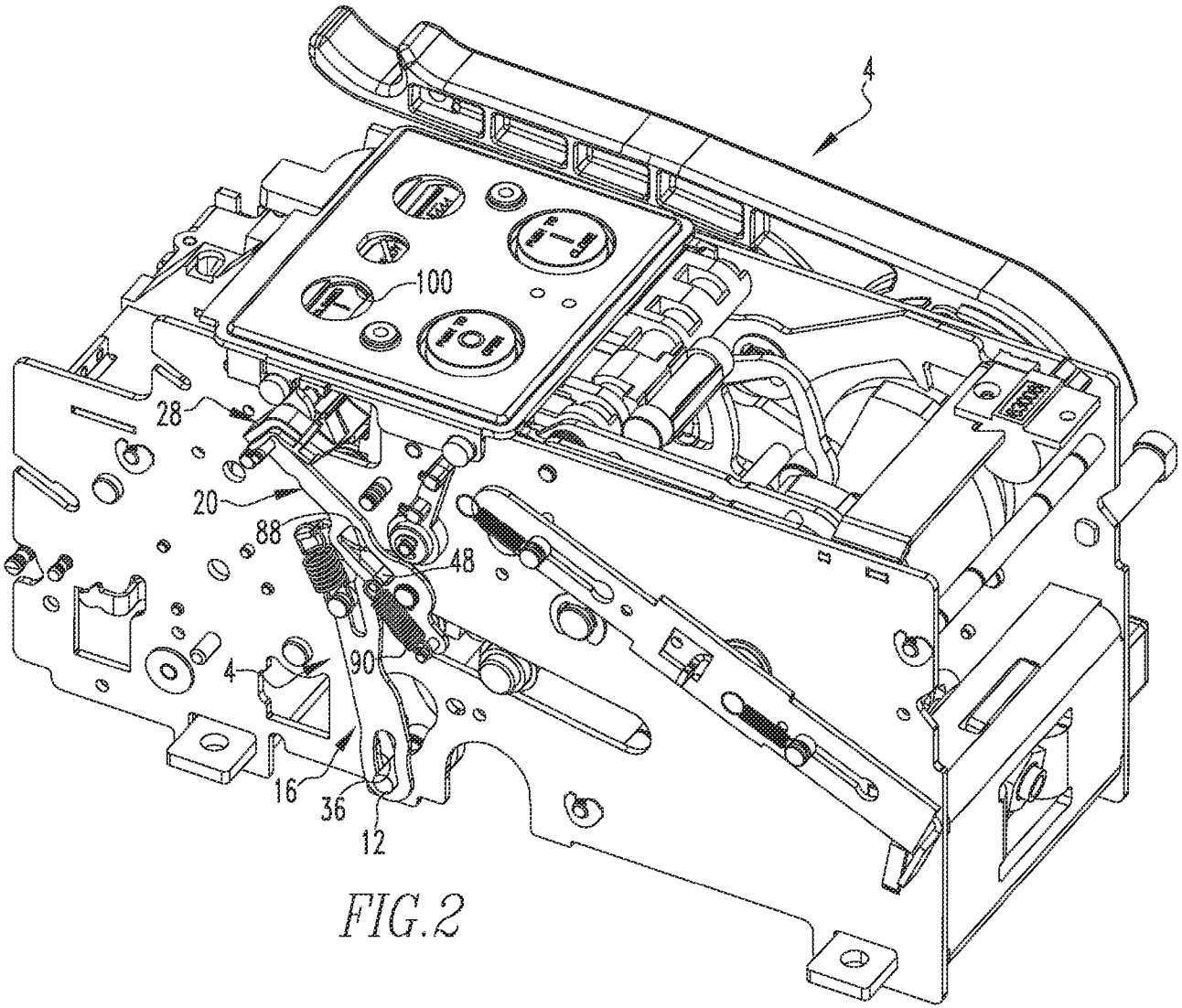
FIG. 2 is a view similar to FIG. 1, except depicting the circuit interrupter and the indicator apparatus in a perspective fashion.

An improved circuit interrupter 2 is depicted in FIGS. 1 and 2 as including an improved indicator apparatus 4 and as further including a mechanism 6 that is configured to control the separation of the set of separable contacts that are internal to the circuit interrupter 2 and that are not expressly depicted herein. The mechanism 6 thus switches the circuit interrupter 2 between an OPEN condition and CLOSED condition in a fashion that is generally understood in the relevant art. The mechanism 6 can be generally said to include a poleshaft 8 (FIG. 1) that is mechanically connected with a drive pin 12 that can be said to operate the indicator apparatus 4. While the poleshaft 8 can generally be said to mechanically connect together a plurality of sets of separable contacts that are associated with a plurality of poles of the circuit interrupter 2, it is understood that the circuit interrupter 2 can be of numerous embodiments without departing from the present concept, and it is further understood that the exemplary circuit interrupter 2 depicted generally herein is intended merely as an example and is not intended to be limiting.

As can be understood from FIGS. 1 and 2, the indicator apparatus 4 can be said to include a first movable element 16, a second movable element 20, a connection apparatus 24 that enables the first and second movable elements 16 and 20 to be cooperable, and an indicator element 28 with which the second movable element 20 is cooperable. The specific configuration depicted herein for the indicator apparatus 4 is intended to be merely exemplary in nature and can be of other configurations without departing from the present concept.

The first movable element 16 can be said to include an elongated first link 32 having a first slot 36 and a second slot 40 formed therein. The first and second slots 36 and 40 each are elongated openings whose use and function will be described in greater detail below. The first movable element 16 further includes an arm 44 that extends from the elongated first link 32 and a lug 48 that protrudes from the arm 44. As will be described in greater detail below, the lug 48 serves as an engagement structure that is engageable with the second movable element 20.

The first slot 36 is configured to have the drive pin 12 received therein and is configured to terminate at a first end 52 and at a second end 54 that are opposite one another. The second slot 40 is configured to receive therein an idler pin 56 that is situated on the circuit interrupter 2. The first movable element 16 further includes a retention spring 60 that extends between the idler pin 56 and a protruding tab 64 situated on the elongated first link 32.

The second movable element 20 can be said to include an elongated second link 68 having formed therein a hole 72 that is structured to receive therein a pivot pin 74 that is situated on the circuit interrupter 2. The pivot pin 74 can be said to include a pivot 76 which is depicted in FIG. 1 as being coincident with the axis about which the elongated second link 68 pivots and which is represented at the center of the pivot pin 74.

The elongated second link 68 has formed therein a receptacle 78 within which the lug 48 is received. The second movable element 40 further includes a follower pin 80 situated on the elongated second link 68 at an end that is situated on the opposite side of the pivot 76 from the receptacle 78. The elongated second link 68 further includes a free end 82 which, in the depicted exemplary embodiment, is situated opposite the location of the follower pin 80.

The elongated second link 68 includes an elongated portion 84 which can be said to form another engagement structure. The elongated portion 84 includes an engagement surface 88 which is depicted herein in an exemplary fashion as being generally planar along nearly the entirety of its length. As will be described in greater detail below, the lug 48 is engageable with the engagement surface 88 to restrain clockwise (from the perspective of FIG. 1) rotation of the second movable element 20, but the lug 48 and the engagement surface 88 may not remain engaged with one another at all times.

The connection apparatus 24 can be said to include a biasing element 90 which is depicted herein as being a tension spring. The connection apparatus 24 depicted herein can also be said to include the aforementioned engagement structures which are depicted herein as being the lug 48 and the engagement surface 88 that are engageable with one another. The biasing element 90 extends between the lug 48 and the follower pin 80.

The indicator element 28 is pivotable about a pivot point 94 that is depicted generally in FIGS. 1, 3-5, and 7. In general terms, the exemplary indicator element 28 includes a first leg 96 and a second leg 98 that are alternately engageable by the free end 82 of the second movable element 20 to cause the indicator element 28 to change states, as will be set forth in greater detail below.

Figure 5:
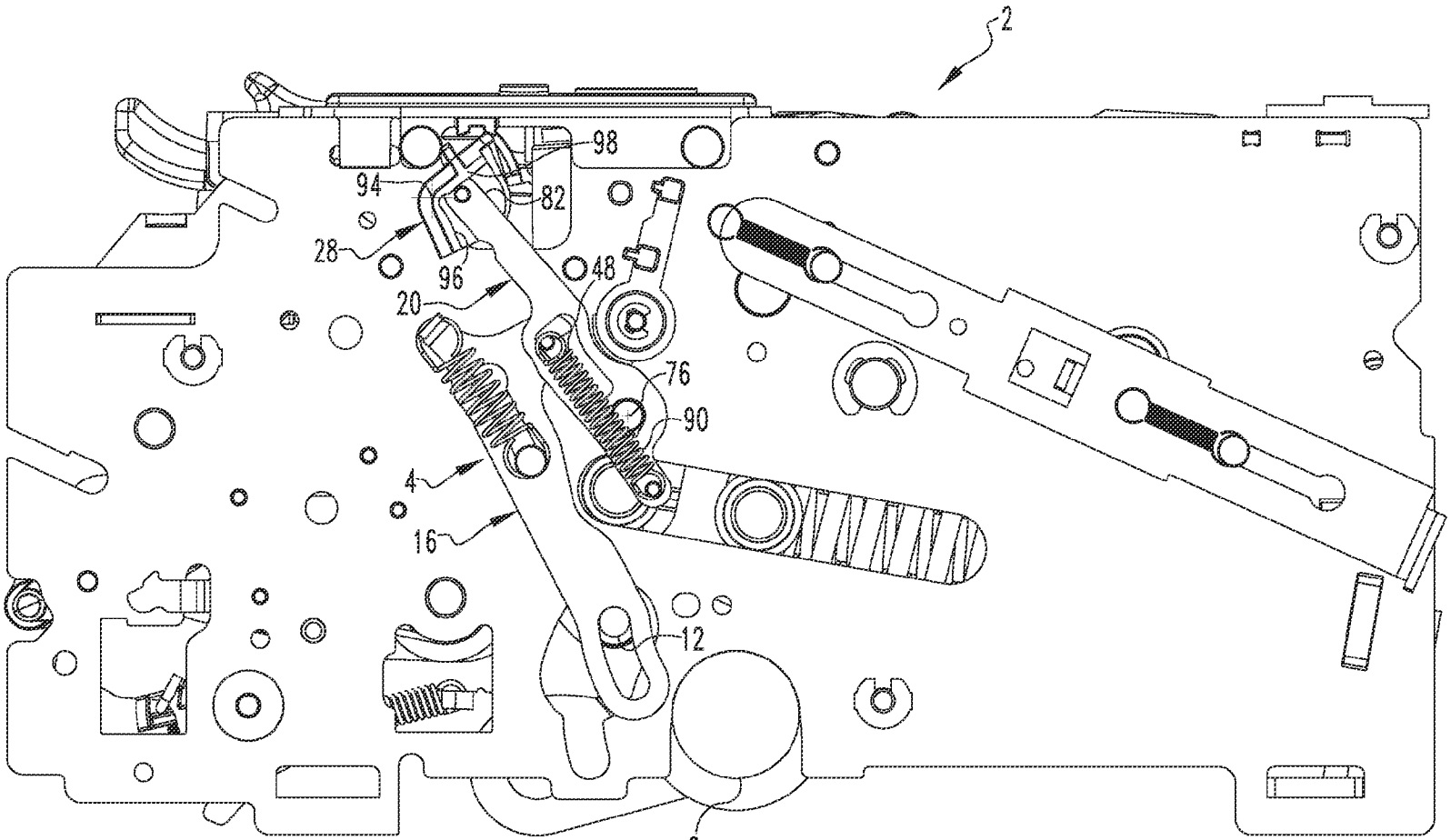
FIG. 5 is a view similar to FIG. 1, except depicting the circuit interrupter in an OPEN condition wherein the set of separable contacts (not expressly depicted herein) have reached the complete extent of their separation from one another.
Figure 6:
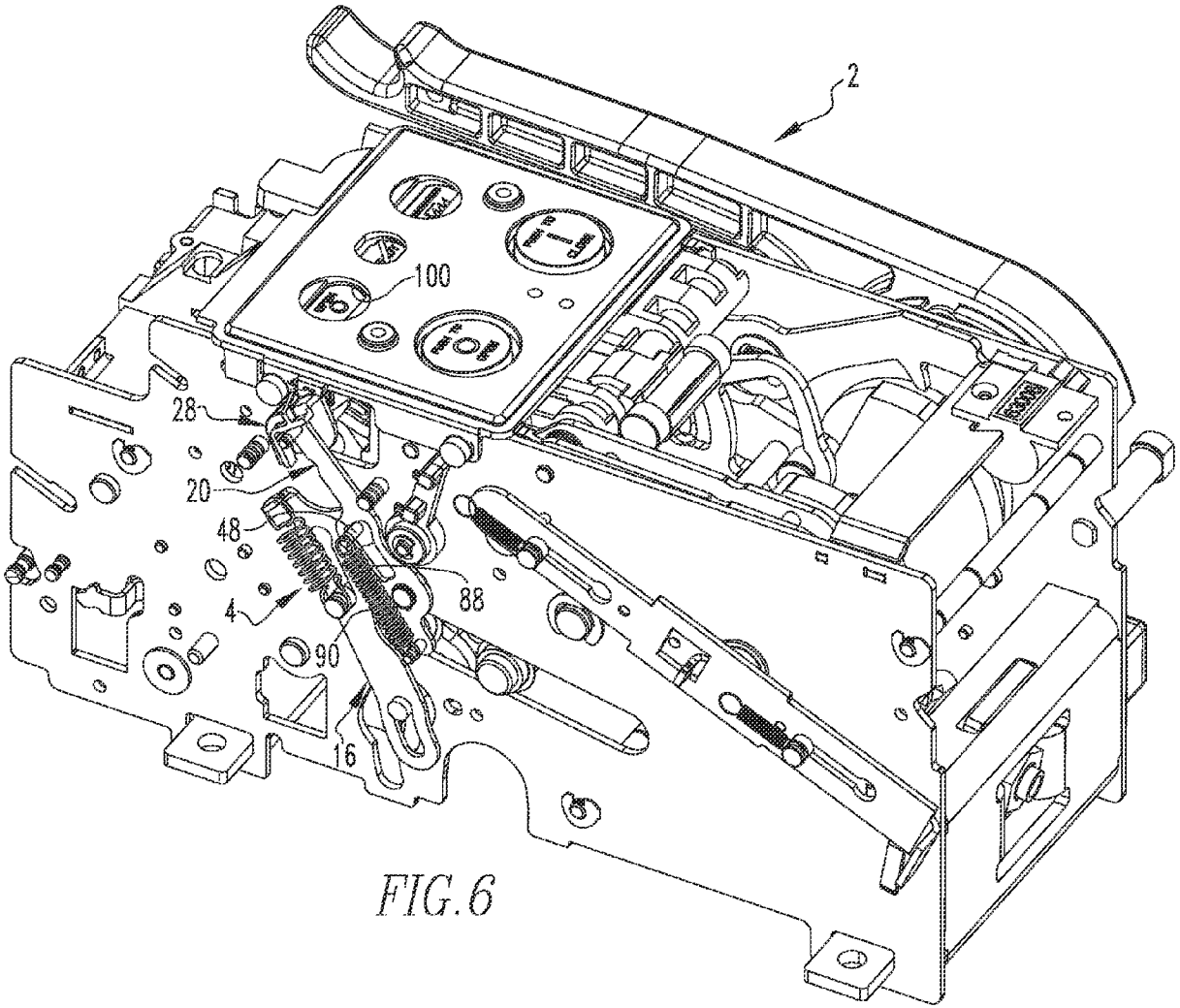
FIG. 6 is a view similar to FIG. 5, except depicting the circuit interrupter and the indicator apparatus in a perspective fashion.

As suggested above, FIGS. 1 and 2 depict the circuit interrupter 2 in a CLOSED condition, meaning that the separable contacts of the mechanism 6 are electrically connected together. In this regard, FIG. 2 depicts on the circuit interrupter 2 an indicator window 100 which depicts the written word "CLOSED" as a representation of the CLOSED condition of the circuit interrupter 2. In contrast, FIGS. 5 and 6 depict the circuit interrupter 2 in an OPEN condition as is indicated by the written word "OPEN" being depicted in the indicator window 100 in FIG. 6. That is, FIGS. 5 and 6 depict the circuit interrupter 2 in a condition wherein the mechanism 6 has fully separated the set of separable contacts to the extent that is capable by the mechanism 6.

Figure 3:
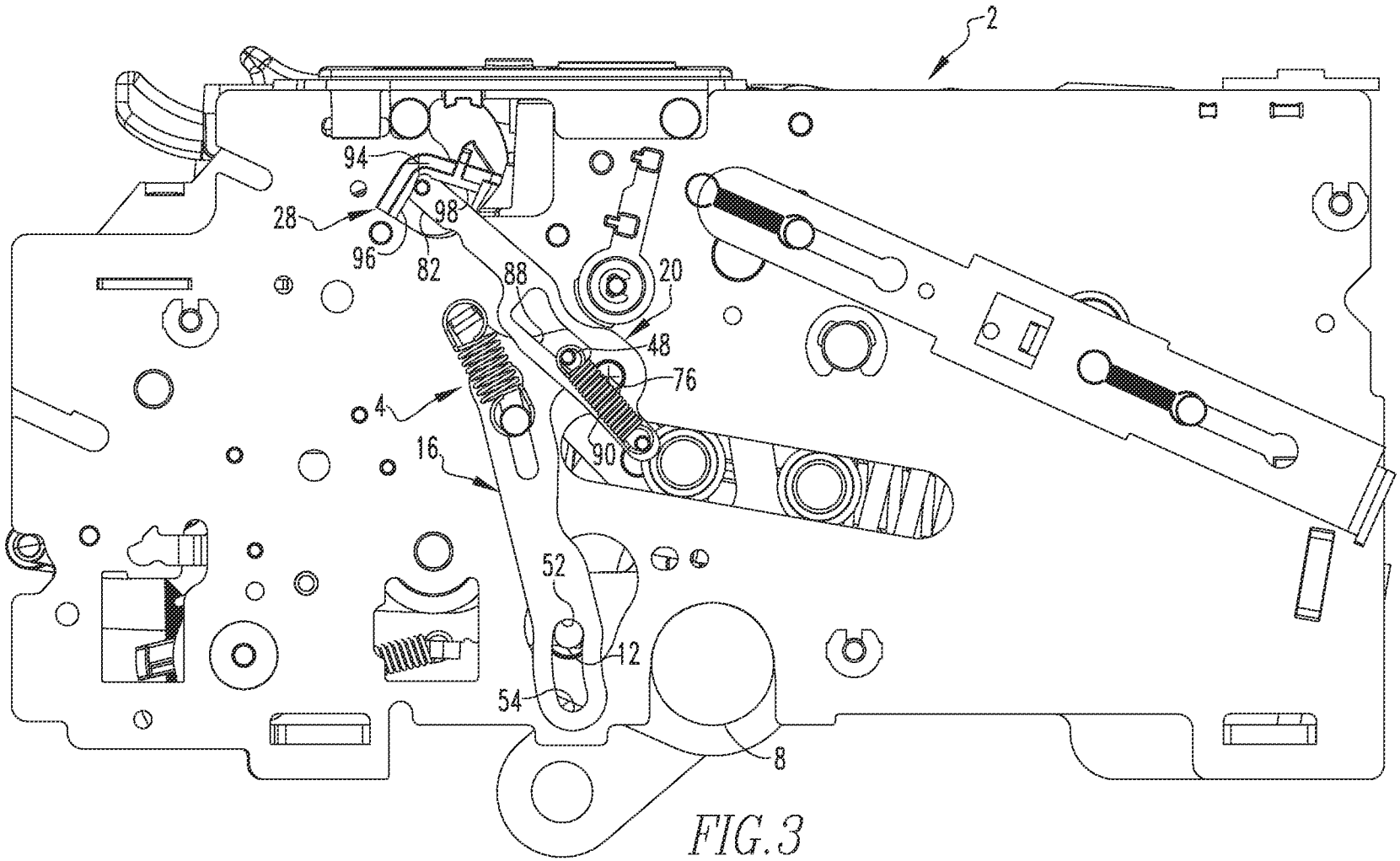
FIG. 3 is a view similar to FIG. 1, except depicting the circuit interrupter and indicator apparatus in a first intermediate condition wherein a set of separable contacts are separated from one another by a first distance but before an indicator element of the indicator apparatus has changed states from a first position (wherein it indicates a CLOSED condition of the circuit interrupter) and a second position (wherein it will indicate an OPEN condition of the circuit interrupter)
Figure 4:
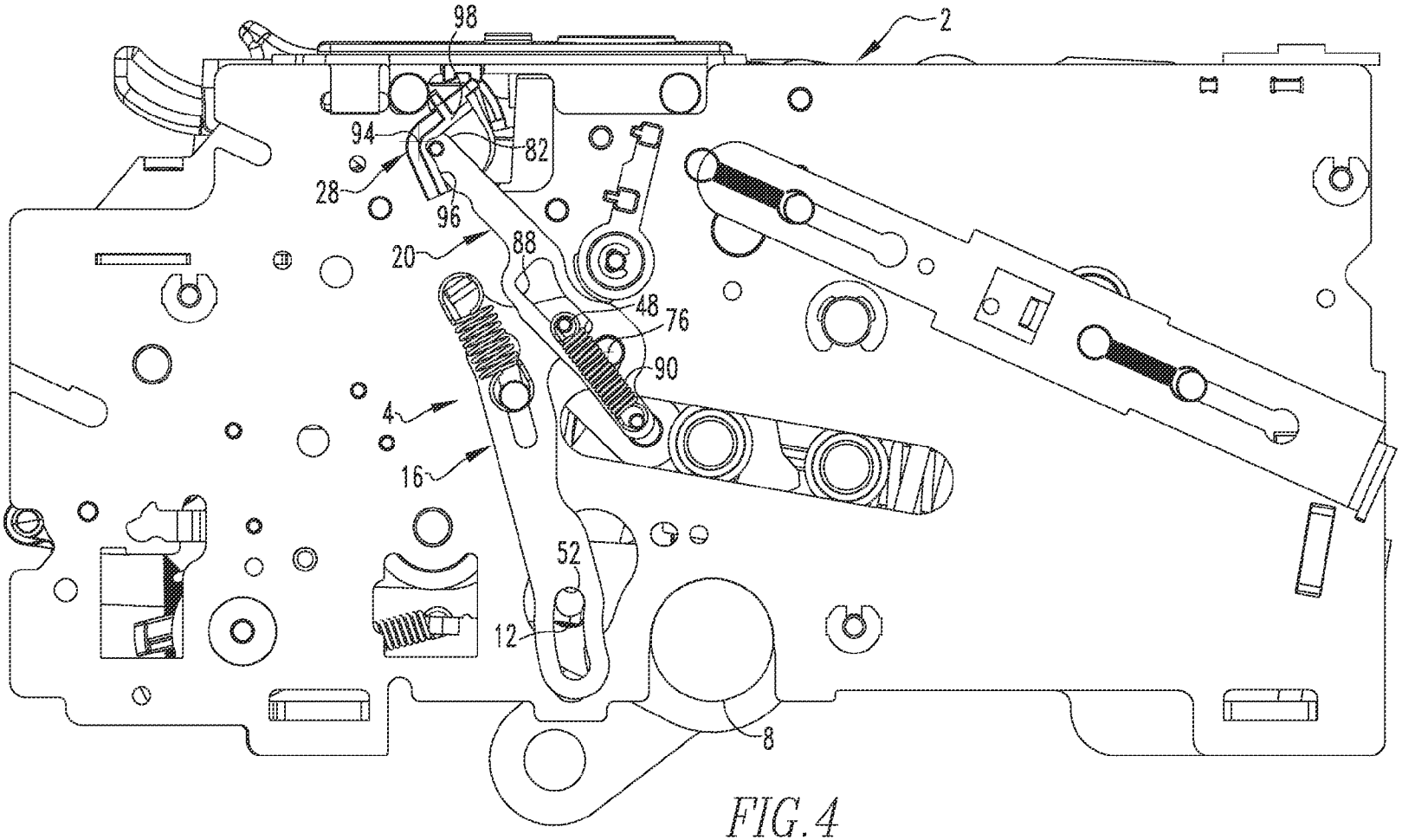
FIG. 4 is a view similar to FIG. 3, except depicting the circuit interrupter in a second intermediate condition wherein the set of separable contacts are separated slightly farther apart than in FIG. 3, and wherein the indicator element has changed states to its second position wherein it indicates an OPEN condition of the circuit interrupter.
Figure 7:
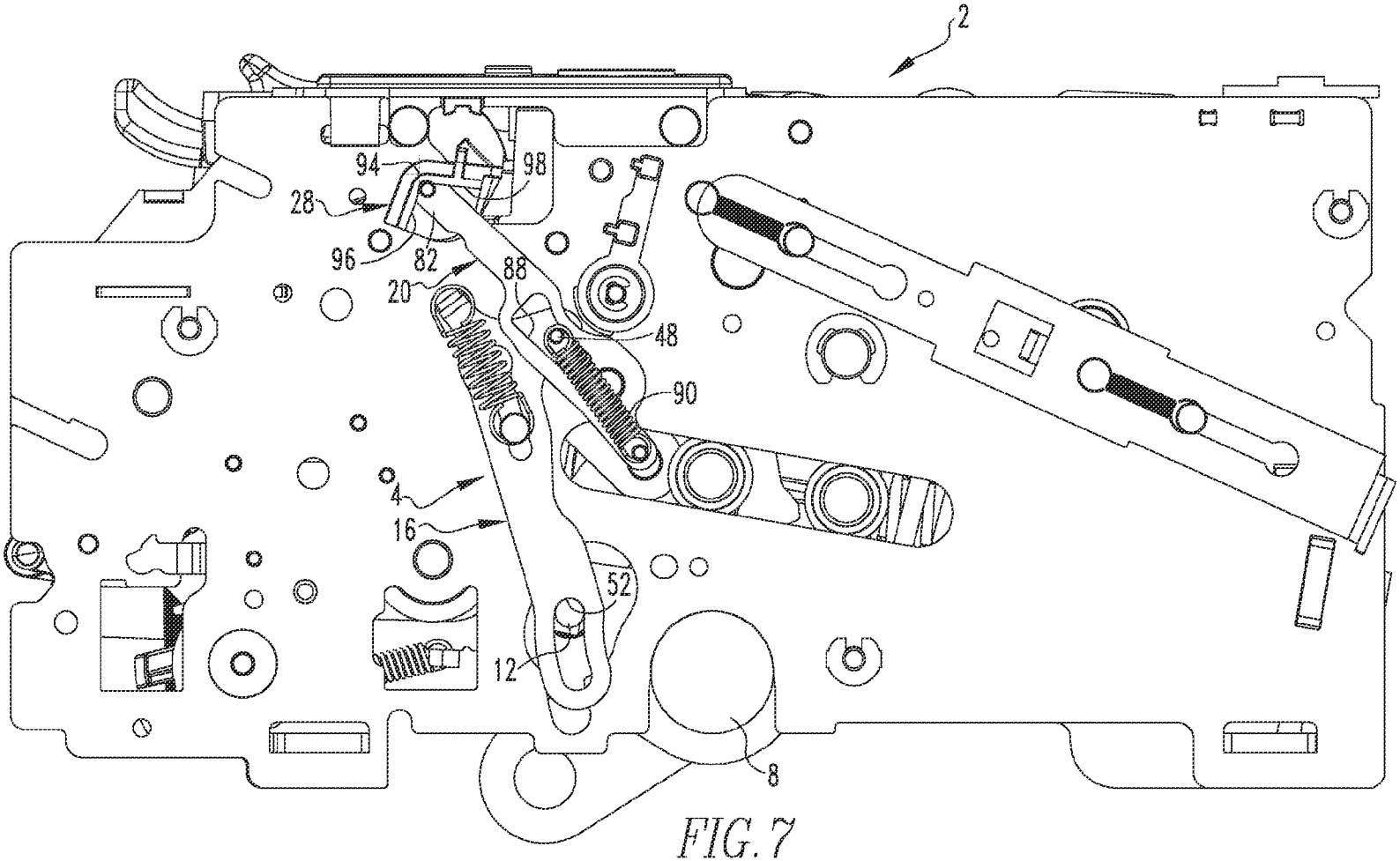
FIG. 7 is a view similar to FIGS. 3 and 4, except depicting another intermediate condition of the circuit interrupter and indicator apparatus during a trip event when the indicator element is on the verge of changing states from the (depicted) first position to the second position.

It is noted, however, that FIGS. 3 and 4 depict first and second intermediate positions of the circuit interrupter 2 between the CLOSED condition of FIGS. 1 and 2 and the OPEN condition of FIGS. 5 and 6. It is further noted that FIG. 7 depicts another intermediate position of the circuit interrupter 2 during a trip event, as will be discussed in greater detail below.

In the CLOSED condition of the circuit interrupter 2 as is depicted generally in FIGS. 1 and 2, the poleshaft 8 has been rotated in the counter-clockwise direction from the perspective of FIG. 1 to the position depicted therein to cause the separable contacts to become electrically engaged with one another (not expressly depicted herein). The drive pin 12 of the mechanism 6 is engaged with the second end 54 of the first slot 36 and has translated the first movable element 16 a small distance in the generally downward direction from the perspective of FIG. 1 to cause a slight tension in the retention spring 60 and to cause the lug 48 to engage the engagement surface 88 and pivot the second movable element 20 in a counter-clockwise direction (again from the perspective of FIG. 1) and to have the position depicted generally in FIGS. 1 and 2.

In the CLOSED condition of the circuit interrupter 2, as is depicted generally in FIGS. 1 and 2, the first movable element 16 is in a first position, the second movable element 20 is in a first position, and the indicator element 28 is in a first position. In contrast, in the OPEN condition of the circuit interrupter 2 depicted generally in FIGS. 5 and 6, the first movable element 16 is in a second position, the second movable element 20 is in a second position, and the indicator element 28 is in a second position. The advantageous transition between the first positions of the first and second movable elements 16 and 20 and the indicator element 28 as are indicated generally in FIGS. 1 and 2 and the second positions thereof indicated generally in FIGS. 5 and 6 will be described in greater detail below.

Specifically, as the mechanism 6 moves away from the CLOSED condition of FIGS. 1 and 2 and moves in a direction toward the OPEN condition of FIGS. 5 and 6, the poleshaft 8 pivots in a clockwise direction (from the perspective of FIGS. 1, 3-5, and 7) away from the position indicated generally in FIGS. 1 and 2.

FIG. 3 depicts what can be considered to be a first intermediate position between the CLOSED configuration of FIG. 1 and the OPEN configuration of FIG. 5. Specifically, the poleshaft 8 is depicted as having rotated sufficiently to cause the drive pin 12 to become disengaged from the second end 54, move along the first slot 36, and engage the first end 52. In the exemplary embodiment of the circuit interrupter 2 described herein, such position of the poleshaft 8 and the drive pin 12 corresponds with the set of separable contacts having a separation of approximately 0.300 inches, meaning that the protected portion of the circuit with which the circuit interrupter 2 is connected is in an open state, but it can be seen that the indicator element 28 is still in its first position, meaning that the indicator window 100 still depicts the written word "CLOSED" therein, such as is indicated in FIG. 2.

More specifically, from a comparison of FIGS. 1 and 3, it can be seen that the engagement of the drive pin 12 with the first end 52 of the first slot 36 has caused the first movable element 16 to move slightly in an upward direction (from the perspective of FIG. 3), which has caused a corresponding movement of the lug 48 in the same direction, and therefore has resulted in a tension being applied to the biasing element 90 to cause the second movable element 20 to pivot slightly in the clockwise direction from the perspective of FIG. 3. Such pivoting of the second movable element 20 is limited by the engagement of the lug 48 and the engagement surface 88. It can be seen from such pivoting that the free end 82 (which in FIG. 1 had been situated spaced from the pivot point 94 near the free end of the first leg 96) is now in FIG. 3 relatively much closer to the pivot point 94 and is actually on the verge of engaging the second leg 98 of the indicator element 28. It is reiterated, however, that the indicator apparatus 4 depicted in FIG. 3 has not yet moved sufficiently that its indicator element 28 has changed state from its first position depicted generally in FIGS. 1 and 2.

FIG. 4 can be considered to depict a second intermediate position of the circuit interrupter 2 and the indicator apparatus 4 that occurs between the first intermediate position of FIG. 3 and the OPEN configuration of FIG. 5. More particularly, a comparison of FIGS. 3 and 4 reveals that the poleshaft 8 has rotated in the clockwise direction (from the perspective of FIG. 4) a slight additional amount which has raised the first movable element 16 and thus the lug 48 a slight amount in the upward direction (from the perspective of FIG. 4). This has increased the tension in the biasing element 90, causing the second movable element 20 to pivot about the pivot 76 in a clockwise direction (again from the perspective of FIG. 4) to the extent permitted by the engagement of the engagement surface 88 with the lug 48. It can be seen, however, that the slight rotation of the second movable element 20 between its positions in FIGS. 3 and 4 has resulted in a relatively small movement of the free end 82 with respect to the pivot point 94, but the free end 82 has engaged the second leg 98 and has caused the indicator element to change states by moving from its first position (as was depicted generally in FIGS. 1-3) to its second position (depicted generally in FIGS. 4-6). FIG. 4 thus demonstrates that a relatively small rotation of the poleshaft 8 from that of the CLOSED configuration depicted generally in FIG. 1 to the position depicted generally in FIG. 4 has caused the indicator apparatus 4 and specifically the indicator element 28 to change states from the first position (wherein the indicator window 100 indicated the written word "CLOSED" as in FIG. 2) and the second position (as is depicted generally in FIG. 4). The indicator element 28 is in its second position in each of FIGS. 4-6, and the indicator window 100 in FIG. 6 demonstrates that the indicator element 28 is indicating the written word "OPEN", which indicates that the set of separable contacts are electrically separated from one another and that the portion of the circuit that is protected by the circuit interrupter 2 is in an open state. FIG. 4 thus further demonstrates that the advantageous indicator apparatus 4 indicates in the second intermediate position of FIG. 4 that its set of separable contacts are electrically separated and that the portion of the circuit that is protected by the circuit interrupter 2 is in an open condition, as is indicated by the written word "OPEN" displayed in the indicator window 100 (see FIG. 6).

Upon further rotation of the poleshaft 8 in the clockwise direction from the position depicted generally in FIG. 4 to that depicted generally in FIG. 5, the drive pin 12 further pushes the first movable element 16 and the lug 48 in a generally upward condition (from the perspective of FIG. 5), which places additional tension on the biasing element 90 and which causes a slight further rotation of the second movable element 20 in a clockwise direction about the pivot point 74, with such pivoting again being constrained by the engagement of the engagement surface 88 with the lug 48. Such additional slight rotation is demonstrated by the free end 82 sliding along the second leg 98 of the indicator element 28 to a position slightly farther away from the pivot point 94 of the indicator element 28.

In this regard, it can be understood that the indicator element 28 can generally only be in either the first position (FIGS. 1-3) or in the second position (FIGS. 4-6), and is generally at most in a state between the first and second positions for an extremely short period of time, i.e., the time that it takes for the poleshaft 8 to pivot between the positions depicted generally in FIGS. 3 and 4. Moreover, however, it is understood that the first and second positions of the indicator element 28 are not dependent upon the ultimate position of the poleshaft 8 since the over-travel that is afforded by the configuration of the indicator element 28 retains the indicator element 28 in generally either the first position or the second position regardless of the final position of the poleshaft 8. That is, and as can be understood from FIGS. 1 and 3, the poleshaft 8 can move between the positions indicated generally in FIGS. 1 and 3 and can cause the free end 82 of the second movable element 20 to move between its positions depicted generally in FIGS. 1 and 3 with respect to the pivot point 94 while the indicator element 28 remains in its first position. Likewise, and as can be understood from FIGS. 4-5, the indictor element 28 remains in its second position regardless of whether the poleshaft 8 is rotated anywhere between its position depicted generally in FIG. 4 and its position depicted generally in FIG. 5. That is, the free end 82 may be caused to move along the second leg 98 and move relatively farther away from the pivot point 94, but such movement of the free end 82 does not cause the indicator element 28 to change from being in its second position once the interaction between the free end 82 and the indicator element 28 has caused the indicator element 28 to switch states between the first position and the second position, which occurs somewhere between the situations depicted in FIGS. 3 and 4.

From the change in state of the indicator apparatus 4 between that of FIG. 1 and that of FIG. 5, it can be seen that rotation of the second movable element 20 in the clockwise direction (from the perspective of FIGS. 3-5) is generally driven by an increase in the tension in the bias element 90 resulting from movement of the lug 48 in a generally upward direction (again from the perspective of FIGS. 3-5). It is reiterated that such clockwise rotation of the second movable element 20 is limited by the engagement between the engagement surface 88 and the lug 48. Thus, the biasing element 90 can be said to bias together the engagement surface 88 and the lug 48, and such engagement between the engagement structures limits the rotational position of the second movable element 20.

In this regard, therefore, it can be seen from a comparison of FIGS. 1 and 4 that a relatively modest change in the distance between the lug 48 and the pivot 76, such as from a comparison of the distance depicted in FIG. 1 and the distance depicted in FIG. 4, results in a relatively significant effect on the indicator element 28 since the indicator element 28 is caused to change states between the first position depicted generally in FIGS. 1 and 3 and the second position depicted generally in FIG. 4. The positional relationship between the lug 48 and the pivot 76 advantageously enables the indicator apparatus 4 to make use of the amplification of motion that can result from making a change at the relatively small radius from a pivot point, i.e., such as the movement of the lug 48 between its position in FIG. 1 and its position in FIG. 4, compared with a relatively larger change at a greater radius, as is indicated in the change in position of the free end 82 between FIGS. 1 and 4 and resultant change in the state of the indicator element 28.

It is also noted that the positioning of the biasing element 90 generally intermediate the first movable element 16 and the second movable element 20 enables the biasing element 90 to absorb from the first movable element 16 at least a portion of the kinetic energy generated during a trip event. The biasing element 90 can then gradually allow the kinetic energy to be transmitted to the second movable element 20. For example, and as can be seen in FIG. 7 (which depicts a trip event), the poleshaft 8 rotates in a clockwise direction (from the perspective of FIG. 7) at such a high rate of speed that the engagement of the drive pin 12 with the first end 52 of the first slot 36 causes the first movable element 16 and specifically the lug 48 to move in a generally upward direction (from the perspective of FIG. 7) faster than the second movable element 20 is capable of rotating about its pivot 76 due to the inertia of the second movable element 20 and other factors. In particular, FIG. 7 depicts the lug 48 disengaged from the engagement surface 88. In such a condition, the movement of the lug 48 in the upward (from the perspective of FIG. 7) direction has increased the tension in the biasing element 90, thus storing in the biasing element 90 some of the kinetic energy imparted to the first movable element 16 as a result of the rapid movement of the drive pin 12 between the position depicted generally in FIG. 1 and the position depicted generally in FIG. 7 during the aforementioned trip event. By providing the relatively large receptacle 78 within the second link 78, the first movable element 16 is permitted to follow the movement of the drive pin 12 and thus that of the poleshaft 8 while the energy of such rapid movement is gradually transmitted via the biasing element 90 to the second movable element 20 only at the rate at which the second movable element 20 is capable of rotating in response to the bias of the biasing element 90. By interposing the biasing element 90 between the first and second movable elements 16 and 20, the second movable element 20 and the indicator element 28 are advantageously mechanically insulated from the relatively great kinetic energy received by the first movable element 16 in a trip event. This advantageously resists breakage of portions of the indicator apparatus 4 during such a trip event, which is desirable.

In this regard, it is understood that the indicator apparatus 4 is depicted in FIG. 7 as being of the verge of the second movable element 20 pivoting in the clockwise direction to cause the free end 82 to change the state of the indicator element 28 from the first position (depicted generally in FIG. 7) to the second position (as is indicated generally in FIGS. 4-6). Such rotation of the second movable element 20 in the clockwise direction will continue until the engagement surface 88 and the lug 48 engage one another and resist further such clockwise rotation.

In returning the circuit interrupter 2 from the OPEN condition of FIGS. 5 and 6 to the CLOSED condition of FIGS. 1 and 2, the poleshaft 8 is rotated in a counter-clockwise direction from the perspective of FIGS. 1 and 3-5 until the indicator apparatus 4 is in the position depicted generally in FIG. 1. In so doing, the lug 48 will be caused to directly engage the engagement surface 88 of the second movable element 20 to directly cause the second movable element 20 to pivot in a counter-clockwise direction (from the perspective of FIGS. 1 and 3-5) and to thus cause, in turn, the free end 82 to engage the first leg 96 of the indicator element 28 and to change its state from the second position (depicted generally in FIGS. 4 and 5) to the first position (depicted generally in FIGS. 1 and 3). Again, the over-travel permitted by the configuration of the indicator element 28 enables the indicator element 28 to remain in the first position regardless of the exact final rotational position of the poleshaft 8.

The indicator apparatus 4 and resultant circuit interrupter 2 thus advantageously enable an accurate indication of the OPEN and CLOSED conditions of a circuit interrupter 2, and further resist unintended breakage of the indicator apparatus 4 during a trip event on the circuit interrupter 2. Other advantages will be apparent to one of ordinary skill in the relevant art.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An indicator apparatus structured to be used in a circuit interrupter that includes a mechanism which is movable to switch the circuit interrupter between a CLOSED condition and an OPEN condition, the indicator apparatus comprising:

a first movable element structured to be cooperable with the mechanism;

an indicator element structured to be movable between a first position that corresponds with the CLOSED condition of the circuit interrupter and a second position that corresponds with the OPEN condition of the circuit interrupter, the indicator element in at least one of the first position and the second position being structured to output an indication representative of the condition of the circuit interrupter;

a second movable element cooperable with the indicator element to move the indicator element between the first and second positions;

a connection apparatus situated on at least one of the first and second movable elements and structured to enable the first and second movable elements to be cooperable;

the second movable element being pivotable between a first position and a second position, the indicator element being in its first position when the second movable element is in its first position, the indicator element being in its second position when the second movable element is in its second position; and wherein the connection apparatus further comprises a biasing element that is structured to bias the second movable element in a direction generally toward its second position.

2. The indicator apparatus of claim 1 wherein the biasing element is a spring that extends between the first movable element and the second movable element.

3. A circuit interrupter comprising the indicator apparatus of claim 1, the circuit interrupter further comprising a mechanism which is movable to switch the circuit interrupter between a CLOSED condition and an OPEN condition.

4. An indicator apparatus structured to be used in a circuit interrupter that includes a mechanism which is movable to switch the circuit interrupter between a CLOSED condition and an OPEN condition, the indicator apparatus comprising:

a first movable element structured to be cooperable with the mechanism;

an indicator element structured to be movable between a first position that corresponds with the CLOSED condition of the circuit interrupter and a second position that corresponds with the OPEN condition of the circuit interrupter, the indicator element in at least one of the first position and the second position being structured to output an indication representative of the condition of the circuit interrupter;

a second movable element cooperable with the indicator element to move the indicator element between the first and second positions; and a connection apparatus situated on at least one of the first and second movable elements and structured to enable the first and second movable elements to be cooperable;

the second movable element being pivotable between a first position and a second position, the indicator element being in its first position when the second movable element is in its first position, the indicator element being in its second position when the second movable element is in its second position;

the connection apparatus comprising a first engagement structure situated on the first movable element and a second engagement structure situated on the second movable element, the first and second engagement structures being engageable with one another to resist movement of the second movable element in a direction generally toward its second position;

wherein the first movable element is movable between a first position and a second position, the first movable element being structured to be in its first position in the CLOSED condition of the circuit interrupter, the first movable element being structured to be in its second position in the OPEN condition of the circuit interrupter; and the second movable element being pivotable about a pivot, the first engagement structure in the CLOSED condition of the circuit interrupter being structured to be situated relatively closer to the pivot than in the OPEN condition of the circuit interrupter.

5. The indicator apparatus of claim 4 wherein the connection apparatus comprises a biasing element that is structured to bias the second movable element in a direction generally toward its second position, the biasing element extending between the first movable element and the second movable element.

6. A circuit interrupter comprising the indicator apparatus of claim 4, the circuit interrupter further comprising a mechanism which is movable to switch the circuit interrupter between a CLOSED condition and an OPEN condition.

7. An indicator apparatus structured to be used in a circuit interrupter that includes a mechanism which is movable to switch the circuit interrupter between a CLOSED condition and an OPEN condition, the indicator apparatus comprising:

a first movable element structured to be cooperable with the mechanism;

an indicator element structured to be movable between a first position that corresponds with the CLOSED condition of the circuit interrupter and a second position that corresponds with the OPEN condition of the circuit interrupter, the indicator element in at least one of the first position and the second position being structured to output an indication representative of the condition of the circuit interrupter;

a second movable element cooperable with the indicator element to move the indicator element between the first and second positions;

a connection apparatus situated on at least one of the first and second movable elements and structured to enable the first and second movable elements to be cooperable;

wherein the first movable element is movable between a first position and a second position, the first movable element being structured to be in its first position in the CLOSED condition of the circuit interrupter, the first movable element being structured to be in its second position in the OPEN condition of the circuit interrupter;

wherein the second movable element is movable between a first position and a second position, the indicator element being in its first position when the second movable element is in its first position, the indicator element being in its second position when the second movable element is in its second position; and the first movable element when moving in a direction away from the first position and toward the second position being structured to apply a tension to the biasing element, the tension being structured to bias the second movable element in a direction generally toward its second position.

8. The indicator apparatus of claim 7 wherein the connection apparatus further comprises a first engagement structure situated on the first movable element and a second engagement structure situated on the second movable element, the first and second engagement structures being engageable with one another to resist movement of the second movable element in a direction generally toward its second position, the first and second engagement structures being engaged with one another in the first position of the first movable element to retain the second movable element in its first position.

9. A circuit interrupter comprising the indicator apparatus of claim 7, the circuit interrupter further comprising a mechanism which is movable to switch the circuit interrupter between a CLOSED condition and an OPEN condition.

10. An indicator apparatus structured to be used in a circuit interrupter that includes a mechanism which is movable to switch the circuit interrupter between a CLOSED condition and an OPEN condition, the indicator apparatus comprising:

a first movable element structured to be cooperable with the mechanism;

an indicator element structured to be movable between a first position that corresponds with the CLOSED condition of the circuit interrupter and a second position that corresponds with the OPEN condition of the circuit interrupter, the indicator element in at least one of the first position and the second position being structured to output an indication representative of the condition of the circuit interrupter;

a second movable element cooperable with the indicator element to move the indicator element between the first and second positions;

a connection apparatus situated on at least one of the first and second movable elements and structured to enable the first and second movable elements to be cooperable;

the connection apparatus comprising a biasing element that extends between the first movable element and the second movable element;

wherein the first movable element is movable between a first position and a second position, the first movable element being structured to be in its first position in the CLOSED condition of the circuit interrupter, the first movable element being structured to be in its second position in the OPEN condition of the circuit interrupter;

wherein the second movable element is rotatable between a first position and a second position, the indicator element being in its first position when the second movable element is in its first position, the indicator element being in its second position when the second movable element is in its second position;

wherein the indicator element includes a first leg and a second leg and is pivotable between its first and second positions; and the first movable element being structured to move in a direction away from the first position and toward the second position being further structured to apply to the biasing element a biasing force that is structured to pivot the second movable element toward its second position and to engage one of the first and second legs of the indicator element to move the indicator element from its first position to its second position.

11. A circuit interrupter comprising the indicator apparatus of claim 10, the circuit interrupter further comprising a mechanism which is movable to switch the circuit interrupter between a CLOSED condition and an OPEN condition.

12. An indicator apparatus structured to be used in a circuit interrupter that includes a mechanism which is movable to switch the circuit interrupter between a CLOSED condition and an OPEN condition, the indicator apparatus comprising:

a first movable element structured to be cooperable with the mechanism;

an indicator element structured to be movable between a first position that corresponds with the CLOSED condition of the circuit interrupter and a second position that corresponds with the OPEN condition of the circuit interrupter, the indicator element in at least one of the first position and the second position being structured to output an indication representative of the condition of the circuit interrupter;

a second movable element cooperable with the indicator element to move the indicator element between the first and second positions; and a connection apparatus situated on at least one of the first and second movable elements and structured to enable the first and second movable elements to be cooperable;

wherein the first movable element has an elongated opening formed therein that is structured to receive therein a portion of the mechanism of the circuit interrupter.

13. The indicator apparatus of claim 12 wherein the second movable element is pivotable between a first position and a second position, the indicator element being in its first position when the second movable element is in its first position, the indicator element being in its second position when the second movable element is in its second position.

14. The indicator apparatus of claim 13 wherein the connection apparatus comprises a first engagement structure situated on the first movable element and a second engagement structure situated on the second movable element, the first and second engagement structures being engageable with one another to resist movement of the second movable element in a direction generally toward its second position.

15. The indicator apparatus of claim 12 wherein the connection apparatus comprises a biasing element that extends between the first movable element and the second movable element.

16. The indicator apparatus of claim 12 wherein the opening has a first end that is structured to be engaged by the portion of the mechanism to move the first movable element in a direction generally toward its second position, and wherein the opening has a second end that is structured to be engaged by the portion of the mechanism to move the first movable element in a direction generally toward its first position.

17. A circuit interrupter comprising the indicator apparatus of claim 12, the circuit interrupter further comprising a mechanism which is movable to switch the circuit interrupter between a CLOSED condition and an OPEN condition.

* * * * *